US007245198B2

(12) United States Patent
Ozawa

(10) Patent No.: US 7,245,198 B2
(45) Date of Patent: Jul. 17, 2007

(54) MOTOR START RELAY AND AN ELECTRIC COMPRESSOR USING SAME

(75) Inventor: Kouichi Ozawa, Numazu (JP)

(73) Assignee: Sensata Technologies, Inc., Attleboro, MA (US)

( * ) Notice: Subject to any disclaimer, the term of this patent is extended or adjusted under 35 U.S.C. 154(b) by 143 days.

(21) Appl. No.: 10/919,091

(22) Filed: Aug. 16, 2004

(65) Prior Publication Data

US 2005/0046542 A1 Mar. 3, 2005

(30) Foreign Application Priority Data

Aug. 26, 2003 (JP) ..... 2003-301283

(51) Int. Cl.
*H01C 7/10* (2006.01)

(52) U.S. Cl. ..... 338/22 R; 338/234; 361/29

(58) Field of Classification Search ..... 338/22 R, 338/22 SD, 234, 23, 235, 220; 361/29, 31; 318/783

See application file for complete search history.

(56) References Cited

U.S. PATENT DOCUMENTS 4,431,983 A * 2/1984 Rodriguez ..... 338/220
4,894,637 A * 1/1990 Yamada et al. ..... 338/22 R
5,153,555 A * 10/1992 Enomoto et al. ..... 338/22 R
5,606,302 A * 2/1997 Ichida ..... 338/22 R
5,963,125 A 10/1999 Mochida et al.
6,160,473 A 12/2000 Gruhn
6,225,715 B1 * 5/2001 Hoda et al. ..... 310/67 R
2001/0054949 A1 12/2001 Mochida
2002/0154459 A1 10/2002 Lisauskas
2004/0135663 A1 * 7/2004 Jang ..... 338/22 R

FOREIGN PATENT DOCUMENTS

JP 04 078103 3/1992
JP 2891179 2/1999

* cited by examiner

*Primary Examiner*—K. Lee
(74) *Attorney, Agent, or Firm*—Russell E. Baumann

(57) ABSTRACT

A motor start relay (100) comprises a positive temperature PTC thermistor, a PTC case 400 of heat resistant resin for receiving the PTC thermistor horizontally, first and second contact/terminals (500, 560) each having contacts electrically engaged with a respective electrode surface of the PTC thermistor in the PTC case (400), a housing (200) receiving the PTC case (400) and a cover (300) attached on the housing (200). FIG. 9 shows the failsafe mechanism of the present invention. In case of a crack occurring in the PTC thermistor, thermistor portion PTC1 is rotated by spring contact (510) with a force F1, and thermistor portion PTC2 is pushed by spring contact (570) at the reverse direction and is dropped through an opening of the PTC case (400).

8 Claims, 10 Drawing Sheets

MOTOR START RELAY AND AN ELECTRIC COMPRESSOR USING SAME

FIELD OF THE INVENTION

This invention relates generally to a motor start relay for starting a single-phase induction motor, or the like, used in electric compressors, or the like and in particular, to such a motor start relay having a failsafe mechanism.

BACKGROUND OF THE INVENTION

A motor start circuit to be used in refrigerator or air-conditioner motors is shown in FIG. 11. In that figure, a positive temperature coefficient of resistivity (PTC) thermistor 11 is serially connected with the start winding S of a motor 10 that has a start winding S and a main winding M. An overload protection device 12 is connected to common terminal C of start winding S and main winding M. PTC thermistor 11 has a low resistance at normal ambient temperature when the motor has first been started, with a result that a sufficient amount of start current flows through start winding S to start the motor.

After start-up of the motor, PTC thermistor 11 generates heat due to electric current that flows through it heating up the thermistor, with a consequence that the resistance of the PTC thermistor rises suddenly, bringing about a state of high resistance and maintaining a balanced state with a current of several tens of milli-amperes. In the event of an overload operation or the like of motor 10, overload protection device 12 opens the circuit through common terminal C in response to elevated temperature caused by the excess current and/or the temperature of the winding. Three air-tight terminals are provided at the top of the shell of sealed compressors (which will hereafter be referred to as terminal pins) for an external interface for connection to start winding S, main winding M and common terminal C. The motor start relay accommodates PTC thermistor 11 in an insulated housing and spring terminals are biased against the electrode faces of PTC thermistor 11 as well as having parts which grip onto the terminal pins.

It is known to provide a failsafe mechanism in a motor start relay to deal with breaking of a PTC thermistor element. Reference may be had to Japanese Patent No. 2,891,179, a figure of which is shown in FIG. 12 of this application, for an example of such a mechanism. The positive temperature thermistor device that has been described in that patent has a first spring contact member 40 and a first positioning protrusion 56 engaging first electrode 38 of a positive temperature thermistor 35 that is accommodated in a casing 32 and a second spring contact member 43 and a second positioning protrusion 57 engaging the opposing second electrode 39.

The first spring member 40 and the second spring contact member 43 are located along the direction of an inclined line relative to the face of thermistor 35 and the first positioning protrusion 56 and the second positioning protrusion 57 are located in the direction of another inclined line relative to the face of the thermistor. The first spring contact member 40 is located adjacent to the outer periphery on one face further from the center than the second positioning protrusion 57 on the other face. Likewise, the second spring contact member 43 is located adjacent to the outer periphery on the other face further from the center than the first positioning protrusion 56 on the said one face.

As a result of what has been described above, the direction of the moments acting on thermistor 35 as a result of the spring action of the first and second spring contact members 40 and 43 relative to protrusions 56 and 57 are as indicated by arrows 58 and 59. Angled surfaces 60 and 61 are formed on the outer peripheries of the first and second positioning protrusions 56 and 57.

If the positive temperature thermistor 35 cracks and is damaged, for example, as the result of an arc, the broken parts are shifted in a direction away from each other because of the spring action of the first and second spring contact members 40 and 43, thereby preventing any possible short-circuiting or molten deposition of the broken parts. Thus, a positive action will open the circuit.

Nevertheless, the positive temperature thermistor device as shown in the above referenced part is subject to the following limitations.

In view of the fact that, according to the failsafe mechanism shown in FIG. 12, the positive temperature thermistor 35 is fixed by using the first and second spring contact members 40 and 43 as the force application points and the first and second offset positioning protrusions 56 and 57 as the fulcrums, the first and second positioning protrusions 56 and 57 will always be in contact with the electrode of the positive temperature thermistor 35 during operation when the temperature of the thermistor is high.

In the case where the first and second positioning protrusions 56 and 57 are formed integrally with the housing, it is necessary for the material used for the housing be formed of resin that has a high level of resistance to heat.

Moreover, the positive temperature thermistor 35 is inserted from above the case 32 (in a direction which is perpendicular to the face of the sheet of the drawing), with a result that the first and second spring contact pieces 40 and 43 will be extending into the space in which the positive temperature thermistor 35 is to be inserted. Accordingly, insertion of the positive temperature thermistor 35 is difficult and the spring contact members and positive temperature thermistor will have to be assembled by using jigs.

SUMMARY OF THE INVENTION

It is an object of the invention to provide a small, low cost motor start relay having a positive temperature thermistor with a failsafe mechanism which is easily assembled.

Another object of the invention is the provision of a motor starter relay having a positive temperature coefficient of resistivity thermistor which is free of the above noted prior art limitations.

A motor start relay made according to the preferred embodiment of the invention comprises a disc shaped positive temperature coefficient of resistivity (PTC) thermistor having opposing first and second electrode layers on opposite face surfaces of the thermistor and a PTC case made of a heat-resistant resin for seating the PTC thermistor. First and second electrically conductive contact/terminal members have respective first and second contacts that are spring biased into electrical engagement with the respective first and second electrode layers of the PTC thermistor. The PTC case is received in a housing that includes a chamber and a cover is received on the housing to close the chamber.

The first and second contacts engage the respective electrode layers of the PTC thermistor at locations offset from each other, the second contact engaging the second electrode layer at a location in line with an empty chamber portion on the other side of the PTC thermistor and with the second contact biasing the thermistor toward the empty chamber portion.

The PTC thermistor case includes a PTC thermistor receiving opening in the top surface of the case and a bottom portion for mounting the thermistor approximately horizontally so that the PTC thermistor will be approximately in parallel with the bottom wall of the housing. The first contact is disposed below the PTC thermistor in a complimentary shaped recess formed in the bottom portion. The opening formed in the top surface of the PTC thermistor case exposes the second electrode layer of the PTC thermistor that has been arranged horizontally in the PTC case. It is desirable for the opening to include a shape commensurate with the disc-shaped PTC thermistor with the second contact disposed above the PTC thermistor.

The first contact preferably presses approximately the center of the first electrode layer of the PTC thermistor and the second contact preferably presses an outer peripheral offset part of the second electrode layer of the PTC thermistor.

Preferably, the top surface of the PTC case is formed with a lip which protrudes into the circular opening at a location generally diametrically opposite to the position of the second contact. When the PTC thermistor is pressed by the spring force of the first and second contacts, the thermistor is biased into engagement with the lip effectively holding that portion of the thermistor along with the first contact. Should the PTC thermistor break, the broken portion aligned with the second contact will be discharged or moved out of the PTC case by the spring force of the second contact. In addition, when the PTC thermistor breaks away, discharge of the said broken portion is abetted by its own weight. By keeping the broken portion away from the remaining portion, possible molten deposition or short-circuiting between the broken elements can be prevented.

According to a feature of the invention, the first and second contact/terminal members have first and second spring attachment parts at locations spaced from the first and second contacts and the first and second spring attachment parts elastically grasp respective terminal pins inserted from the through holes formed in the housing.

In addition, the first and second contact/terminal members have first and second external terminals at positions on an extension from the first and second contacts, and the first and second external terminals may be formed to protrude externally through respective openings formed in the cover.

Preferably, the housing is formed so that an overload protector for protection of the motor from an overload operation or over-temperature conditions can be connected to it with at least part of the protector being covered.

An electric motor according to this invention has a motor start relay with the features described above, the motor mounted within a shell that includes a plurality of terminal pins forming an external interface with the main winding and the start winding. The first and second spring attachment parts of the contact terminal members of the motor start relay being connected to the terminal pins.

The plurality of terminal pins are desirably provided at the top of the shell and the motor start relay is connected to the terminal pins so that the housing and the PTC thermistor are positioned horizontally. In addition, the protector, if used, is connected to the start relay and to the terminal pin for common included in the plurality of terminal pins.

According to this invention, the PTC thermistor is accommodated in a PTC case in which the contact positions of the first and second contact/terminal members are offset from each other, thereby making it possible, when the PTC thermistor is damaged, to discharge a broken portion from the PTC case and effectively prevent short-circuiting that could take place due to molten deposition among the broken portions.

For the purpose of accommodating the PTC thermistor in the case and realizing a failsafe mechanism by using the PTC case, it is not necessary for the housing itself to directly hold the PTC thermistor. Accordingly, potential choices for the selection of suitable material for the housing to withstand the heat of the PTC thermistor can be expanded. As a result, it becomes possible to make the housing using a heat-resistant resin which is less costly than those used in the past.

In view of the fact that the PTC thermistor is positioned approximately horizontally in the PTC case and in the housing, it becomes possible to realize a reduced height or thin motor start relay as compared with the conventional structure in which the PTC thermistor is held perpendicularly.

Due to the arrangement of the first and second contacts, it is not necessary to employ a special tool, thereby improving the efficiency of the assembly work for the motor start relay.

BRIEF DESCRIPTION OF THE DRAWINGS

The accompany drawings, which are incorporated in and constitute a part of the specification, illustrate the preferred embodiment of the invention and, together with the description, serve to explain the objects, advantages and principles of the invention. In the drawings:

FIG. 2(*b*) is a perspective view of the FIG. 2(*a*) housing;

FIG. 3(*b*) is a side elevational view of the FIG. 3(*a*) cover;

FIG. 3(*c*) is a front elevational view of the FIG. 3(*a*) cover;

FIG. 4(*b*) is a cross sectional view taken along line A-A of FIG. 4(*a*);

FIG. 4(*c*) is a front elevational view of the FIG. 4(*a*) case;

FIG. 4(*d*) is a side elevational view of the FIG. 4(*a*) case;

FIG. 5(*b*) is a cross sectional elevational view of the FIG. 5(*a*) structure;

FIG. 6(*b*) is a top plan view of the FIG. 6(*a*) contact/terminal member;

FIG. 7(*b*) is a side elevational view of the FIG. 7(*a*) terminal;

FIG. 9(*b*) is a cross sectional view of the FIG. 9(*a*) structure but also showing the first contact which engages the opposite electrode surface of the PTC thermistor;

FIG. 9(*c*) is a view similar to FIG. 9(*a*) but shown with the PTC thermistor broken and FIG. 9(*d*) is a cross sectional view similar to FIG. 9(*b*) but of the FIG. 9(*c*) structure and first contact. The FIGS. 9(*c*) and 9(*d*) views are used in explaining the operation of the failsafe mechanism when the PTC thermistor has been broken;

DETAILED DESCRIPTION OF THE PREFERRED EMBODIMENT

Figure 1:
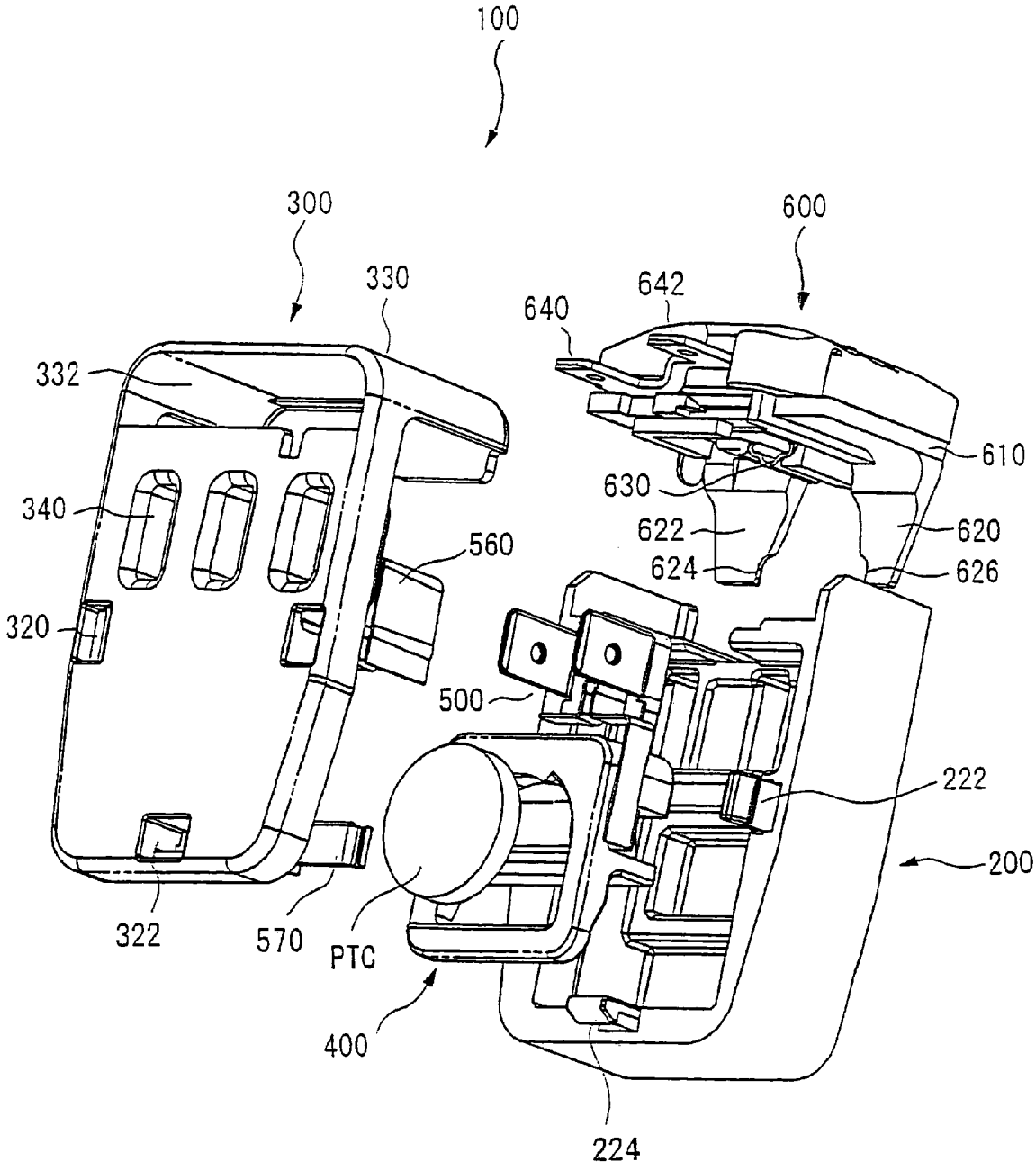
FIG. 1 is a blown apart perspective view of a motor start relay made in accordance with the preferred embodiment of the invention.

As shown in FIG. 1, the start relay 100 comprises a housing 200 formed of a thermoplastic and heat-resistant resin such as polybutyrene terephthalate (PBT), a cover 300 formed of like material, a thermistor mounting PTC case 400 formed of suitable material such as a thermoplastic polypheneylene sulfide (PPS) and whose purpose is to accommodate a circular or disc shaped positive temperature coefficient of resistivity thermistor (which will hereafter be abbreviated as PTC thermistor) and a pair of contact/terminal members 500 and 560 which are connected to the PTC thermistor.

In addition, a protector 600 for opening the circuit to the motor upon overload or over-temperature conditions is removably attached to the motor start relay 100 in this embodiment.

Figure 2A:
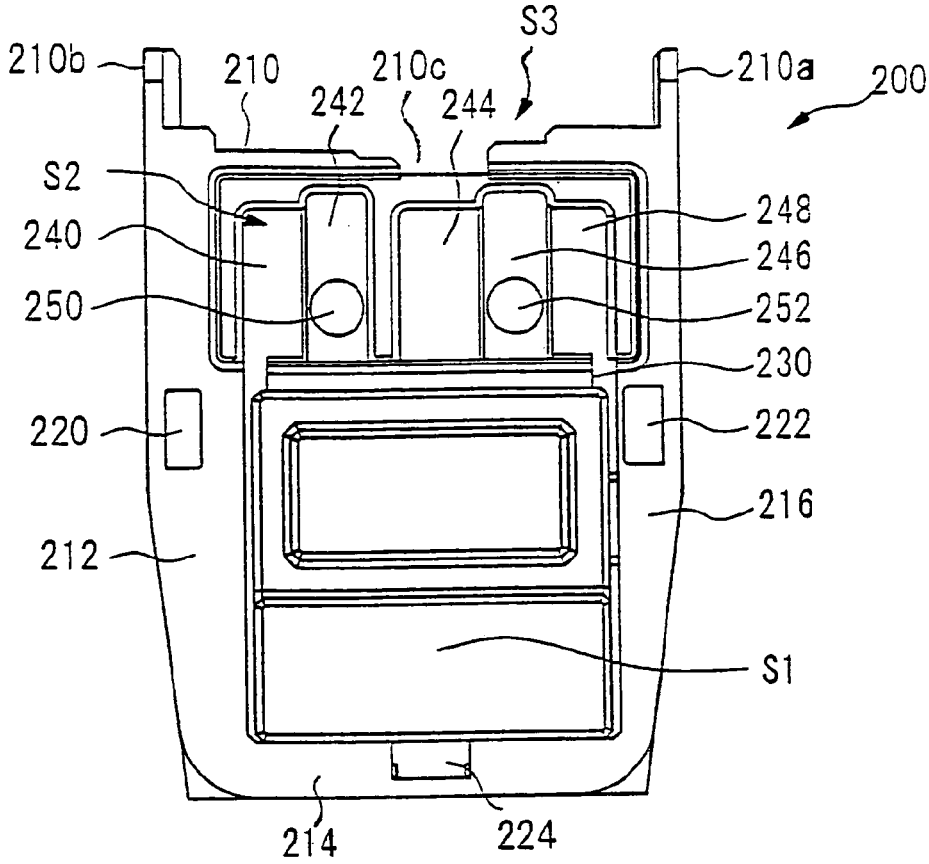
FIG. 2(*a*) is a top plan view of a housing of the FIG. 1 relay.
Figure 2B:
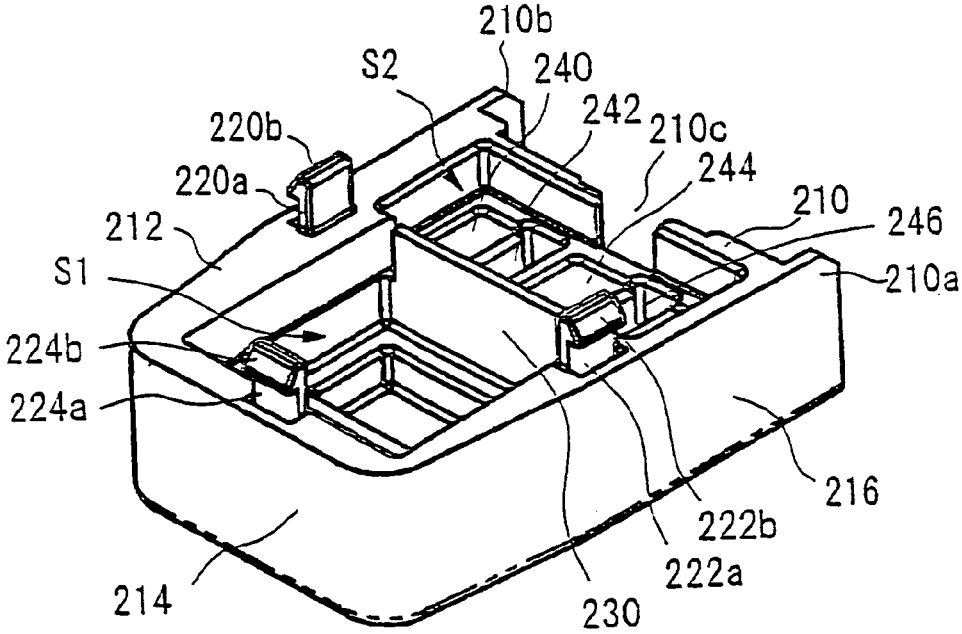

With reference to FIGS. 2(*a*), 2(*b*), housing 200 includes a generally rectangular bottom wall and sidewalls 210, 212, 214 and 216 which extend upwardly therefrom along the outer periphery of the bottom wall forming a chamber having spaces S1, S2. Hooks 220 and 222 are respectively formed on the top faces of opposing sidewalls 212 and 216 and a hook 224 is formed on the top face of sidewall 214. Hooks 220, 222 and 224 include respective parts 220*a*, 222*a* and 224*a* that extend upwardly from the top and the protrusions 220*b*, 222*b* and 224*b* that project laterally therefrom. These hooks engage with cover 300 to be described below.

A partition wall 230 is formed approximately at the center of housing 200. In top plan view, rectangular space S1 of the chamber is defined by partition wall 230 and sidewalls 212, 214 and 216 and similarly in top plan view, a rectangular space S2 of the chamber is defined by partition wall 230 and sidewalls 210, 212 and 216. The PTC case 400 is received inside a portion of space S1 and side-by-side recesses 240, 242, 244, 246 and 248 are formed via spaced apart walls in the bottom wall of housing 200 within space S2 for mounting the contact/terminal members, to be discussed. A circular through-hole 250 is formed through the bottom of recess 242 for receiving a terminal pin connected to the start winding and, through the bottom of recess 246, a circular through-hole 252 is formed for receiving a terminal pin connected to the main winding.

A space S3 is formed by a pair of protrusions 210*a* and 210*b* that extend from both ends of sidewall 210 of housing 200 in the direction of sidewalls 212 and 216. An opening 210*c* is formed in sidewall 210 and extends to the bottom approximately at the center of sidewall 210. An overload protector 600, as shown in FIG. 1, is arranged in space S3.

As shown in FIG. 1, protector 600 includes a pair of thin plate like parts 620 and 622 that protrude from the main body of casing 610. Plate like parts 620 and 622 are inserted in matching gaps (not shown in the drawing) formed on the bottom of the housing 200. When plate like parts 620 and 622 have been inserted into the gaps in the bottom of housing 100, the pair of protrusions 210*a* and 210*b* support both sides of protector 600 and semicircular cut-away portions 624 and 626 formed at the tips of the plate like parts 620 and 622 are aligned with the pair of through-holes 250 and 252.

A metal pin receiving terminal 630 made of spring material having a pin receiving opening is provided at the center of the main casing body 610 of the protector 600. As the terminal pin that serves as a common terminal for the main winding and the start winding is inserted in the pin receiving opening, the metal terminal 630 is electrically connected with the common terminal pin. When protector 600 is installed in space S3, metal terminal 630 is disposed inside opening 210*c* of sidewall 210.

Protector 600 has a well known bimetal switch employing a bimetal heat-responsive element with opening and closing between the contact points effected through movement of the bimetal element. A pair of terminals 640 and 642 provided on the side of the main body of casing 610 are electrically connected respectively to the contact points of the bimetal switch inside the main casing body. Moreover, one terminal 640 is electrically connected to terminal 630 by means of an electrically conductive member (not shown in the drawing) that extends on the outer periphery of the main casing body 610. When the motor is in normal operation, the terminals 640 and 642 are placed in conductive relation with each other; however, they will be rendered non-conductive upon an overload or over-temperature condition.

Figure 3B:
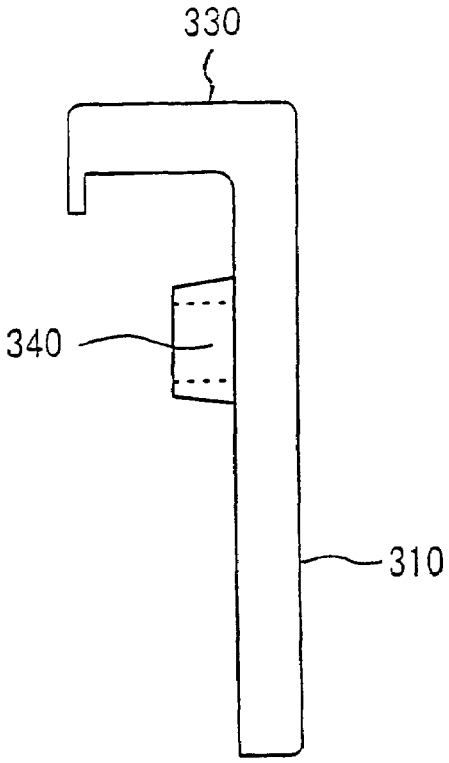
FIG. 3(*a*) is a top plan view of a cover of the FIG. 1 relay.
Figure 3A:
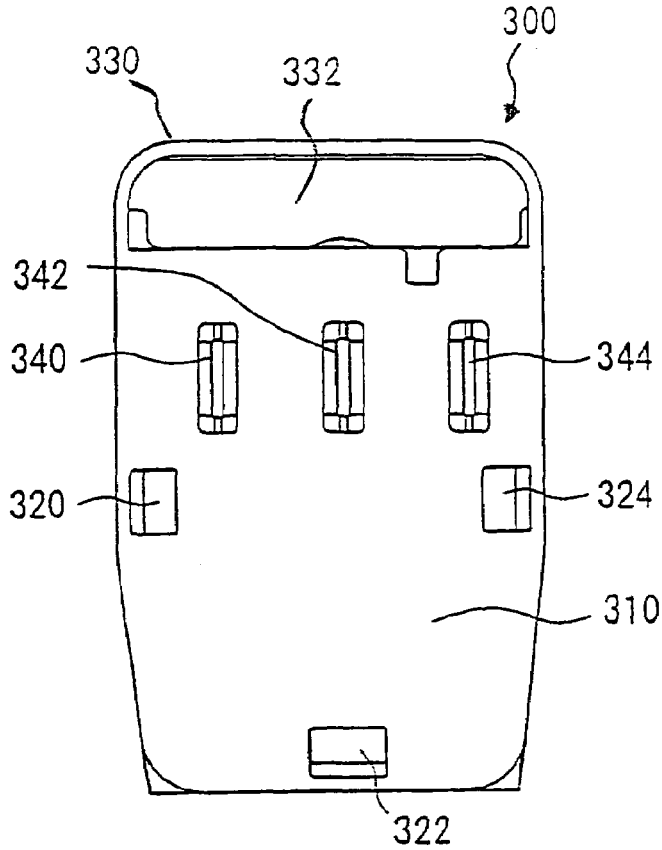
Figure 3C:
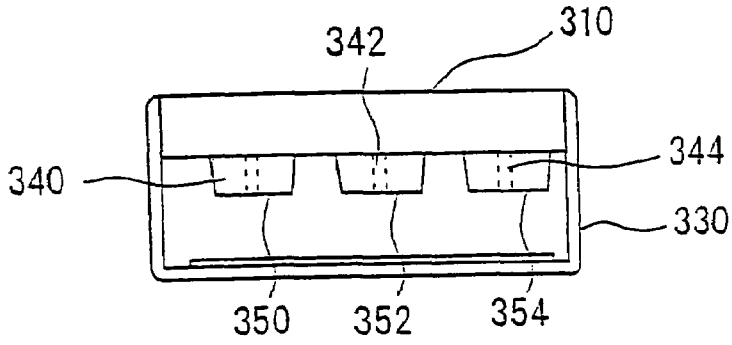
Figure 4A:
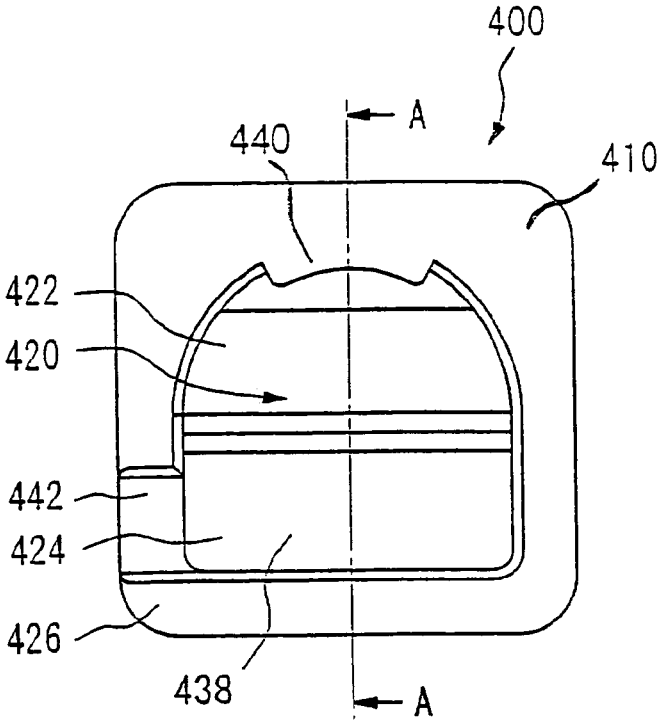
FIG. 4(*a*) is a top plan view of a PTC thermistor case of the FIG. 1 relay.
Figure 4B:
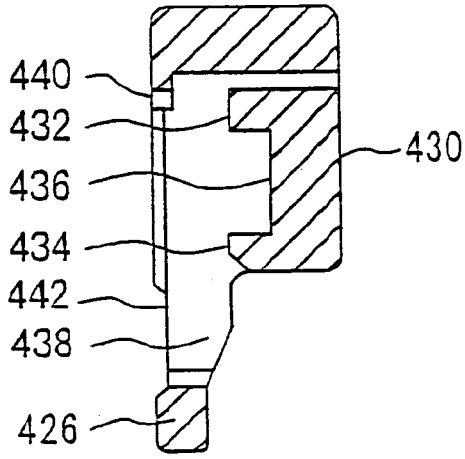
Figure 4C:
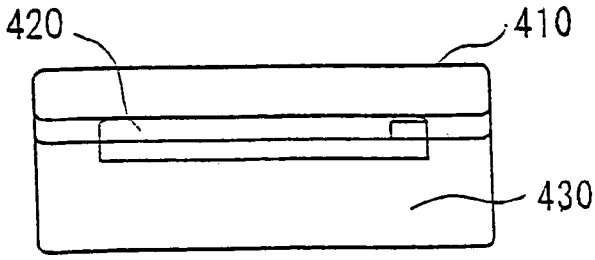
Figure 4D:
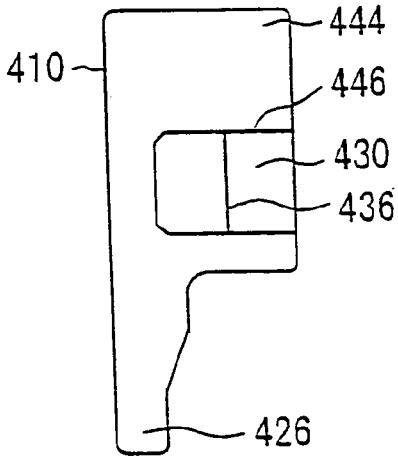

With reference to FIGS. 3(*a*), 3(*b*) and 3(*c*), cover 300 has a main face 310 whose shape is approximately the same as the peripheral shape of housing 200, with holes 320, 322 and 324 being formed at preselected locations on the outer periphery of the main face 310. These holes 320, 322 and 324 engage respectively with protrusions 220*b*, 224*b* and 222*b* of hooks 220, 224 and 222 as the cover 300 is installed on the upper surface of housing 200, thereby substantially sealing spaces S1 and S2 inside housing 200.

An opening or window 332 is formed between a rear sidewall 330 and the main face 310 of cover 300. When protector 600 is mounted on housing 200, rear sidewall 330 covers sides of protector 600 and window 332 exposes terminals 630, 640 and 642 of protector 600.

In addition, three slot-like openings 340, 342 and 344 are arranged along a straight line on the main surface 310. Protrusions 350, 352 and 354, which include openings 340, 342 and 344, are formed on the reverse side of the main surface 310. When cover 300 has been installed on housing 200, protrusions 350, 352 and 354 are aligned with respective recesses 240, 244 and 248.

The PTC case 400 shown in FIG. 4(*a*) is a generally rectangular frame, with a seating portion 420 being formed on its upper or main surface 410. The seating portion 420 has a first opening portion, generally semicircular opening 422, and a second opening portion, generally rectangular opening 424, that extends therefrom down to the lower frame body 426. The semi-circular opening 422 has a diameter in conformity with the outside shape of the disk-shaped PTC thermistor that is to be accommodated therein.

A bottom portion 430 is formed at a location which is generally aligned with the semicircular opening 422. Support parts 432 and 434 are formed on the upper surface of the bottom portion 430 and comprise two laterally extending band-like protrusions with recess 436 formed therebetween. The support parts 432 and 434 have flat top surfaces and are of the same height. The second opening portion or rectangular opening 424, has no bottom, thereby constituting a cavity 438 that runs through the case.

An arc-shaped lip 440 protrudes from main surface 410 of PTC case 400 into the semi-circular opening 422 in such a way as to cover a part of the semi-circular opening 422. A gap 442 having a selected width is formed on main surface 410 and this gap is made to communicate with the rectangular opening 424. A rectangular groove 446 is formed on side 444 of PTC case 400 that extends for a selected distance from the bottom surface toward the main surface and communicates with recess 436 on bottom portion 430.

Figure 5A:
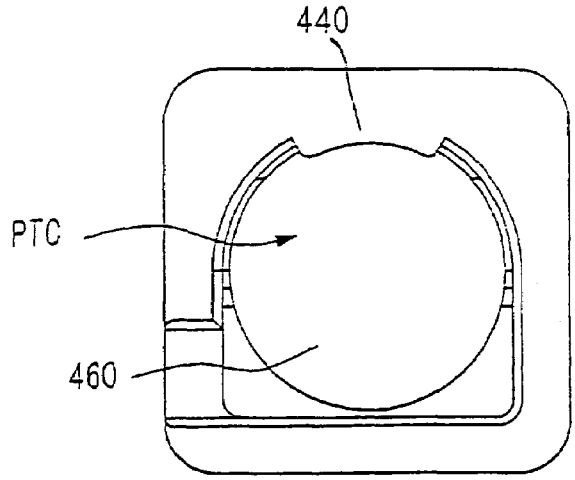
FIG. 5(*a*) is a view similar to FIG. 4(*a*) but shown with a PTC thermistor mounted in the case.
Figure 5B:
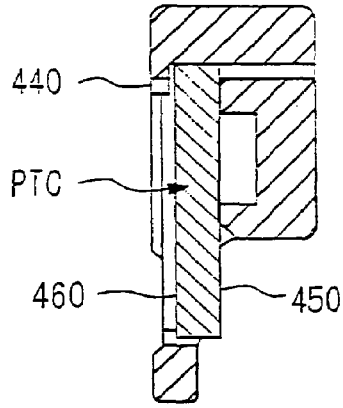

As shown in FIGS. 5(*a*), 5(*b*), when the PTC thermistor is inserted into the seating portion 420 (a spring contact is installed on the PTC thermistor in actuality; however, it is omitted in this view), one of the electrode surfaces 450 of the PTC thermistor (FIG. 5(*b*)) is supported by supports 432 and 434 formed on the bottom portion and the other electrode surface 460 of the PTC thermistor is spaced slightly from the arc-shaped lip 440. When the PTC thermistor that has been inserted into the seating portion 420 is pressed by a spring contact engaging electrode surface 450, the lip 440 supports the PTC thermistor in such a fashion that the PTC thermistor is effectively held and will not easily be dislodged from cavity 438.

Figure 6A:
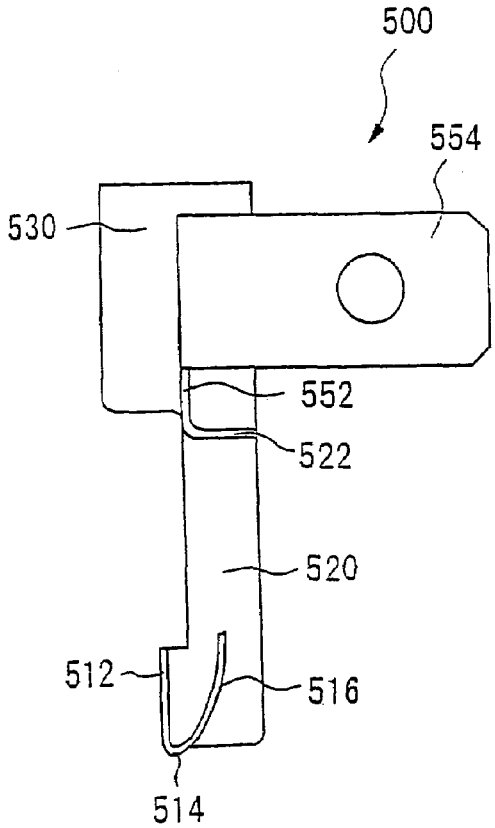
FIG. 6(*a*) is a side elevational view of a first contact/terminal member of the FIG. 1 relay.
Figure 6B:
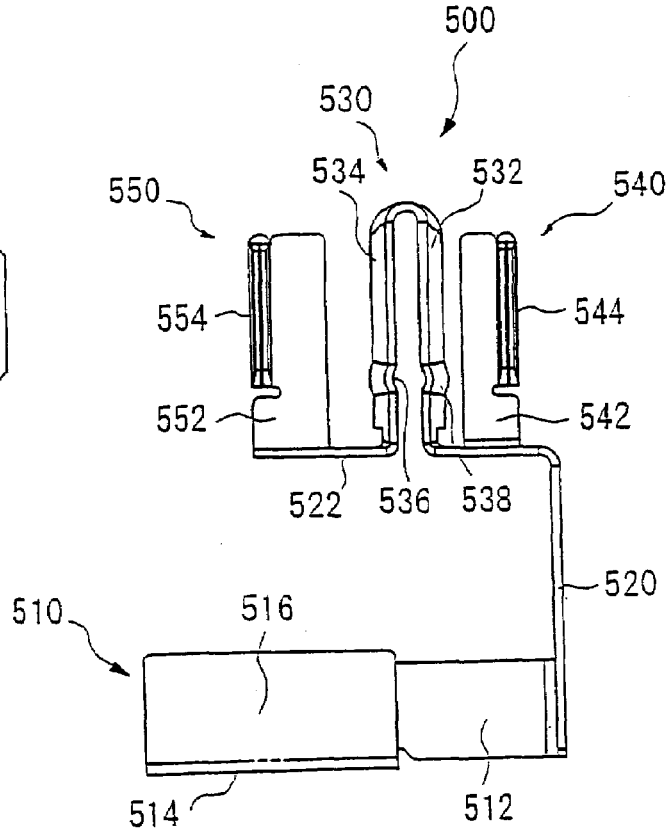

FIGS. 6(*a*), 6(*b*) show the first contact/terminal member 500 that is to be connected to one of the electrode surfaces 450 of the PTC thermistor. The first contact/terminal member 500 is made of suitable electrically conductive spring metal such as beryllium copper or stainless steel.

The first contact/terminal member 500 comprises a first contact 510 that is caused to elastically engage the electrode surface 450 of the PTC thermistor, an extension part 520 that extends perpendicularly from first contact 510, a first spring attachment part 530 integrally connected to a bending part 522 that has been bent at a right angle from the extension part 520 and first and second external terminals 540 and 550 that likewise are integrally connected to bending part 522. Regarding the first contact/terminal member 500, the above-mentioned various parts may be advantageously formed by punching from plate material, for example.

First contact 510 has a base 512 of a selected width and a contact engagement part 516 made by folding the bottom or root portion 514 of base 512 by approximately 180 degrees. The contact engagement part 516 has a surface that slightly curves from the root 514 and this surface provides certain spring function due to the elastic deformation of root 514.

Base 512 and the contact engagement part 516 are inserted through groove 446 formed on side 444 of bottom portion 430 (FIG. 4(*d*)). Thus, base 512 is positioned in recess 436 of the bottom portion 430. Contact engagement part 516 is in a position slightly above supports 432, 434 and it is elastically in engagement with the electrode surface 450 of the PTC thermistor and forms an electrical connection therewith.

With the first contact/terminal member 500 installed, the PTC case 400 is then received in housing 200. At this time, the extension part 520 extends along the side 444 of PTC case 400 as shown in FIG. 1, to be bent therefrom in the right angle direction by bending part 522 and the first spring attachment part 530 is accommodated in recess 246 between spaced apart walls of the recess formed in space S2 of housing 200. The first and second external terminals 540 and 550 are accommodated in recesses 244 and 248 respectively in space S2.

The first spring attachment part 530 has a first plate 532 connected to bending part 522 and a second plate 534 that faces the first plate through the folding of the first plate 532 approximately by 180 degrees in a generally U-shape configuration, and the second plate 534 is also connected to bending part 522.

A certain gap is provided between the first and second plates 532 and 534 and the distance between the first and second plates is changed by the elastic deformation of the bending part. The first and second plates 532 and 534 are formed in such a manner as to preferably incline from the bottom to the top.

The first and second plates 532 and 534 have first and second curved parts 536 and 538 at such locations as will face each other and approximately a circular hole is formed by the first and second curved parts 536 and 538. This hole is aligned with through hole 252 inside the recess 246 with the plates 532, 534 somewhat biased against the spaced apart walls of recess 246.

Because first and second plates 532 and 534 are slightly tilted, the hole that is formed by the first and second curved parts 536 and 538 becomes either conical or bowl-like in shape. When a terminal pin has been inserted from the through-hole 252, the terminal pin is elastically held between the first and second curved parts 536 and 538 and stops at a certain insertion point.

The first external terminal 540 has a base part 542 that is connected to bending part 522 and a terminal 544 that extends from the base part 542. The base part 542 is received inside recess 248 of space S2, with terminal 544 extending therefrom in a perpendicular direction. When cover 300 is placed on housing 200, terminal 544 is received through the slot-like opening 344 of the cover 300 and protrudes from the surface of cover 300.

The second terminal 550 has a base part 552 that is connected to bending part 522 and a terminal 554 that extends from base part 552. Base part 552 is accommodated in recess 244 of space S2, with terminal 554 protruding therefrom in a perpendicular direction. When cover 300 has been placed on housing 200, terminal 554 is received through the slot-like opening 342 of cover 300 and sticks out of the surface of cover 300.

Figure 7A:
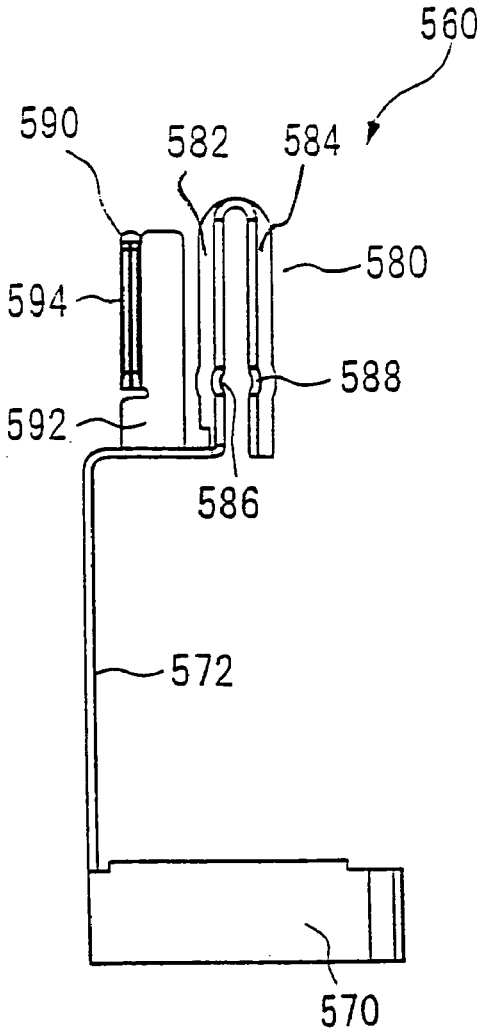
FIG. 7(*a*) is a top plan view of the second spring contact/terminal member of the FIG. 1 relay.
Figure 7B:
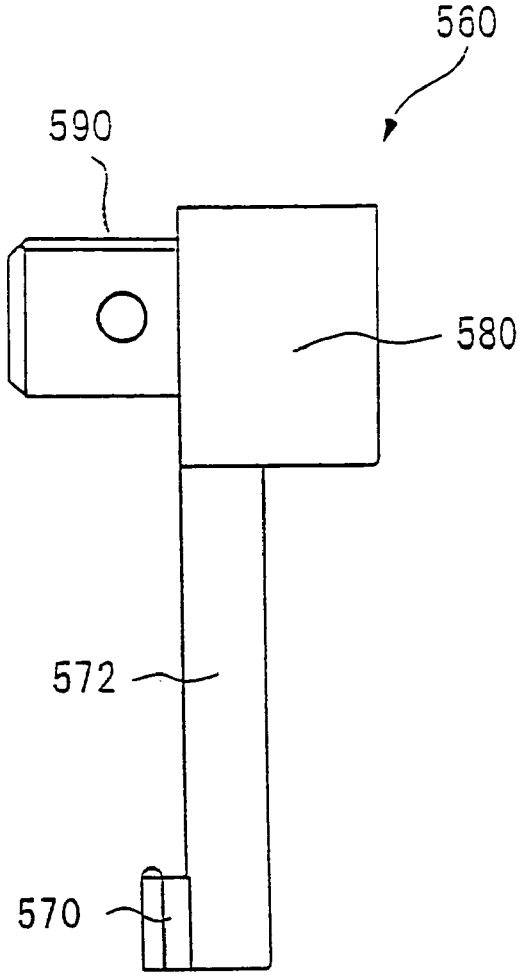

FIG. 7 shows the second contact/terminal member. The second contact/terminal member 560 is made of suitable electrically conductive, spring metal such as beryllium copper or stainless steel and is elastically and electrically connected to the other electrode surface 460 of the PTC thermistor. Second contact/terminal member 560 has a second contact 570, an extension part 572 that extends from the second contact 570 in a perpendicular direction, the second spring attachment part 580 connected to extension part 572 and the third external terminal 590 connected to extension part 572.

Second contact 570 has a selected width and extends in a horizontal direction. Its width is approximately equal to the width of gap 442 formed on main surface 410 of PTC case 400. The second spring attachment part 580, connected to extension part 572, basically has the same structure as the first spring attachment part 530, and includes the first and second U-configured plates 582 and 584. The first and second curved parts 586 and 588 are formed in the first and second plates respectively. The second spring attachment part 580 is received in recess 242 of space S2 of housing 200 somewhat biased together by spaced apart walls of the recess and the hole that has been formed by the first and second curved parts 586 and 588 is aligned with the through-hole 250.

The third external terminal 590 is basically formed in the same manner as the first and second external terminals 540 and 550 and has a base part 592 that is connected to extension part 572 and a terminal 594 that has been connected to the base part 592. Base part 592 is received in recess 240 of space S2 and, when cover 300 has been placed on housing 200, terminal part 594 is received through opening 340 of cover 300 and protrudes from its surface.

Next, an explanation will be given regarding the method for assembling the motor start relay 100. First, contact/terminal member 500 is installed in PTC case 400. As first contact 510 is inserted into groove 446 on side 444 of the PTC thermistor case, it is positioned and held on bottom portion 430.

Next, PTC case 400 is received in housing 200 with the first contact/terminal member installed as shown in FIG. 1. The PTC case is accommodated in space S1 of housing 200 and spring attachment part 530 is received in space S2.

Next, the PTC thermistor is inserted into the seating portion 420 of PTC case 400. The PTC thermistor is angled toward the circular opening 422 from the rectangular opening 424 on main surface 410 of PTC case 400. Then, since contact engagement part 516 of first contact/terminal member 500 projects out beyond supports 432 and 434, the first electrode surface 450 of the PTC thermistor elastically engages contact engagement part 516, with a result that the second electrode surface 460 touches arc-shaped lip 440. As a result of this, the PTC thermistor is captured in cavity 438 of PTC case 400.

Next, the second contact/terminal member 560 is installed on PTC case 400. As described above, second contact 570 of second contact/terminal member 560 is positioned so that it extends through gap 442 on the main surface of PTC case 400 and, moreover, the second spring attachment part 580 and the third external terminal 590 are received in the recesses 242 and 240 of housing 200.

Next, overload protector 600 is installed on the space S3 side of housing 200. As a result of this, metal terminal 630 is positioned in opening 210*c* in sidewall 210 of the housing.

Figure 8:
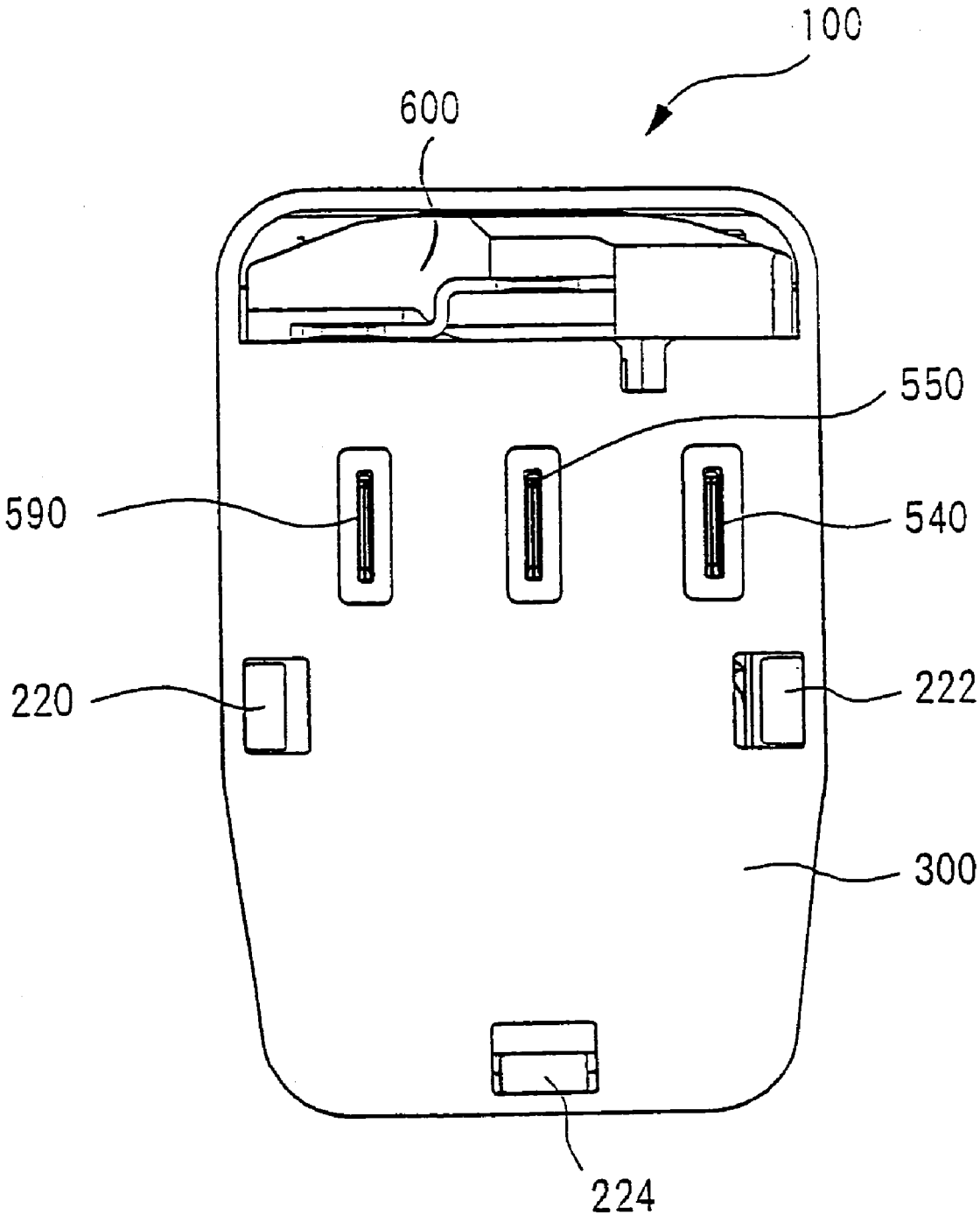
FIG. 8 is a top plan view of the FIG. 1 motor start relay in the assembled condition.
Figure 9A:
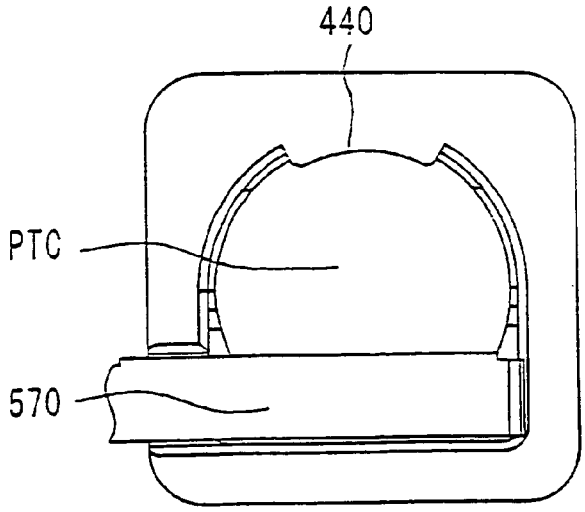
FIG. 9(*a*) is a top plan view of the PTC case in which a PTC thermistor is received and shown with a broken away portion of a second contact which engages one electrode surface of the PTC thermistor.
Figure 9B:
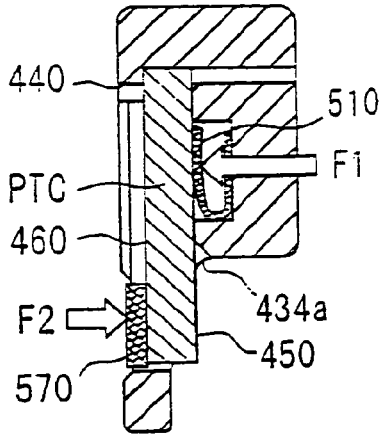
Figure 9C:
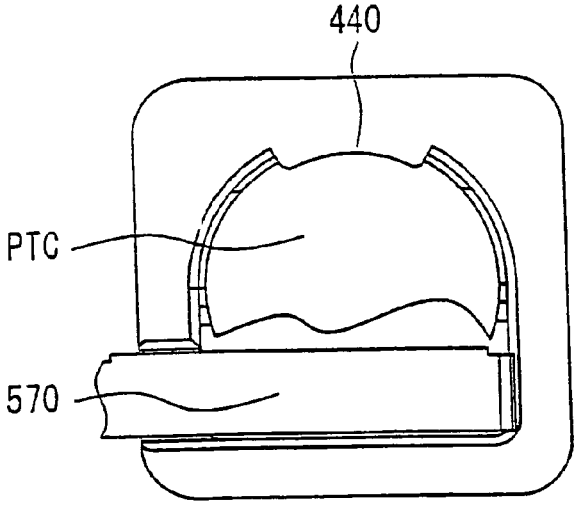
Figure 9D:
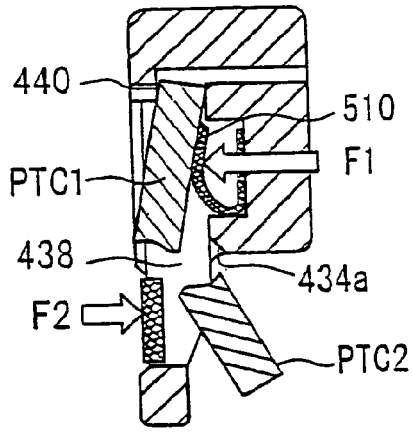

Next, hooks 220, 222 and 224 of housing 200 are inserted into holes 320, 324 and 322 respectively, of cover 300 and the cover is thus installed on housing 200. As cover 300 is installed, second contact 570 of the second contact/terminal member 560 is biased by the cover, with a result that the PTC will assume a state where it is elastically held between the first and second contact/terminal members 500 and 560. FIG. 8 shows the motor start relay 100 assembled as viewed from above.

According to this embodiment, a motor start relay that has a PTC thermistor can be easily assembly without using tools. By making it possible for protector 600 to be installed, moreover, the whole assembly can be made compact. Because the PTC thermistor is arranged horizontally in PTC case 400 and housing 200, the height of the motor start relay can be substantially reduced and made thin relative to conventional relays. Regarding the installation of protector 600, it may be installed any time prior to the installation of cover 300.

Next, operation and the failsafe mechanism of the motor start relay made according to this embodiment will be described. As was explained in connection with an example of a conventional circuit, motor start relay 100 is externally mounted on the terminal pins that are provided on the top (or the upper surface) of a sealed electric compressor, for example. The pin for the start winding is inserted into through-hole 250 of housing 200 and this is held by the second spring attachment part 580 of second contact/terminal member 560. The pin for the main winding is inserted into through-hole 252 and this is held by the first spring attachment part 530 of first contact/terminal member 500. In addition, a pin for the common terminal is inserted into the metal terminal 630 that has been exposed by window 332 of cover 300.

FIGS. 9(*a*)-9(*d*) are shown for the purpose of explaining the failsafe mechanism provided by the PTC case 400. FIGS. 9(*a*) and 9(*b*) indicate the normal state of the PTC thermistor seated in the PTC thermistor case and FIGS. 9(*c*) and 9(*d*) show the state in which the PTC thermistor is broken. One of the electrode surfaces 450 of the PTC thermistor is pressed with force F1 by the first contact 510 of first contact/terminal member 500 and the other electrode surface 460 is pressed with force F2 by second contact 570 of second contact/terminal member 560.

First contact 510 engages the PTC thermistor at the upper half of the PTC thermistor, while second contact 570 engages the PTC thermistor at a diametrically opposed lower half of the PTC thermistor with a result that forces F1 and F2 are offset from each other. A rotary moment is added to the PTC thermistor by forces F1 and F2. This rotary moment is supported by lip 440 that engages the top of the PTC thermistor and serves as a fulcrum.

If the PTC thermistor is cracked, thermistor portion PTC1 on the upper half of the PTC thermistor in opening portion 422, as seen in FIG. 9(*d*), rotates in the clockwise direction by force F1 due to first contact 510, with lip 440 as a fulcrum, and the broken end touches the inner wall of the cover 300 to be left in that state inside the seating portion.

Meanwhile, thermistor portion PTC2 on the lower half of the PTC thermistor in opening portion 424, as seen in FIG. 9(*d*), is pushed out of the PTC case from cavity 438 because of force F2 of second contact 570 and thermistor portion PTC2 is moved in a direction away from the upper half thermistor portion PTC1. Because of this, the development of any possible short-circuiting due to a spark or molten deposition, or the like between the broken thermistor portions PTC1 and PTC2 is actively prevented, thereby realizing a failsafe condition when the PTC thermistor has been broken.

A chamfer 434*a* may be formed on support 434 in order to facilitate the breaking off of the PTC thermistor when a crack is produced in the PTC thermistor. As a result of this, the PTC thermistor which has been damaged is easily broken away by means of the chamfer part 434*a* and easily guided out of cavity 438.

When the terminal pins are provided at the top of the shell of an electric compressor of the sealed type, motor start relay 100 is arranged approximately in a horizontal direction. Accordingly, it becomes possible for the lower half side thermistor portion PTC2 that has been broken to easily drop from cavity 438 of the PTC case because of its own weight in addition to force F2 due to second contact 570.

Figure 10A:
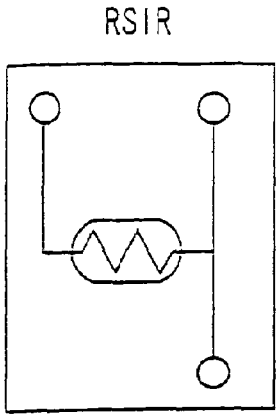
FIGS. 10(*a*), 10(*b*) and 10(*c*) are schematic wiring diagrams of different typical circuit connections used with the motor start relay.
Figure 10B:
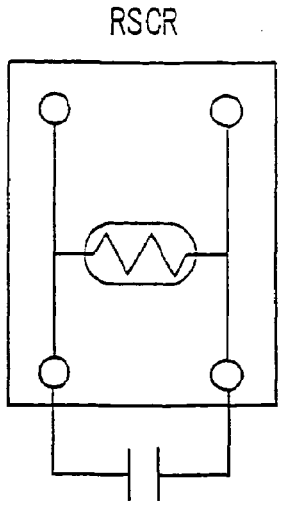
Figure 10C:
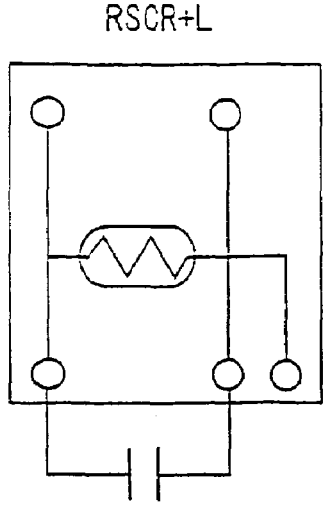
Figure 11:
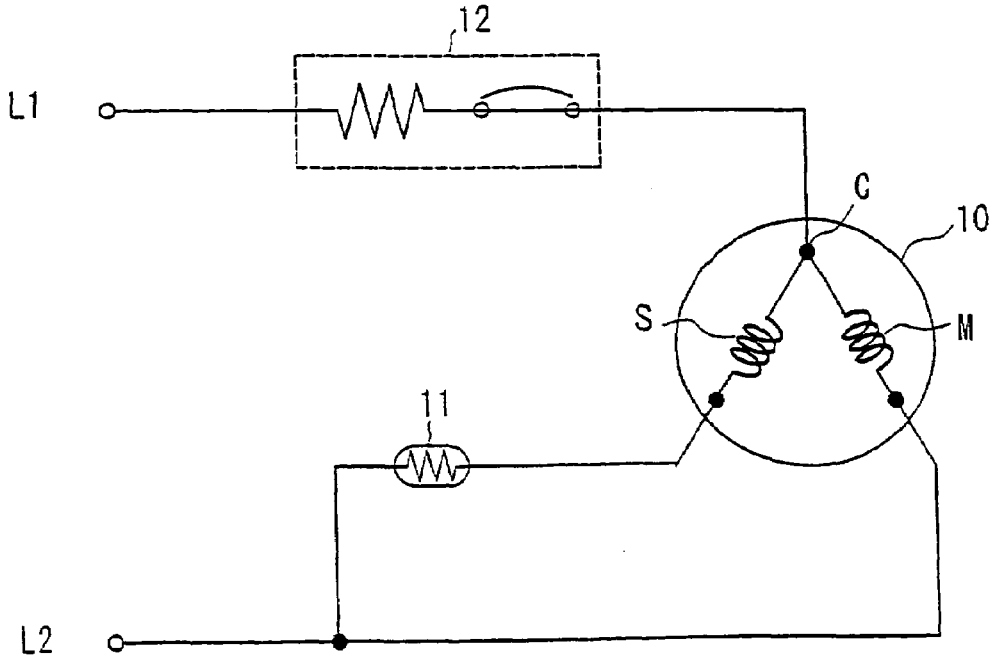
FIG. 11 is a wiring schematic of a motor start circuit.
Figure 12:
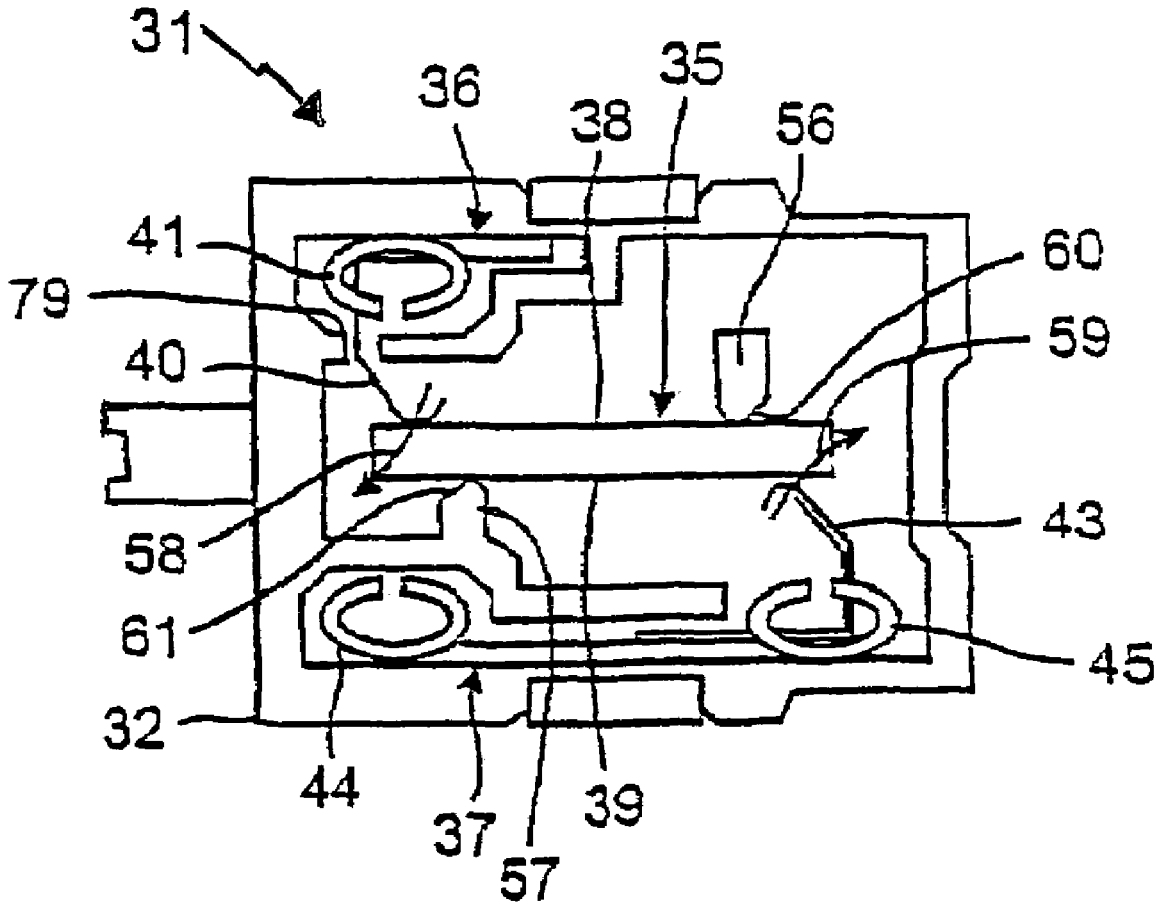
FIG. 12 is a view looking at the main components of a conventional motor start relay.

FIG. 10 shows examples of typical circuit connections when the motor start relay according to this example is employed. FIG. 10(*a*) shows an RSIR connection with no capacitor connected in parallel with the PTC thermistor. FIGS. 10(*b*) and 10(*c*) show examples of the RICR and RSCR+L connections, where the capacitor is connected in parallel with the PTC thermistor. The connection of the capacitor can be carried out by using external terminals 540, 550 and 590 that protrude from cover 300.

In the relay made in according to Japanese Patent No. 2,891,179 noted above, the PTC element is inserted in a direction parallel to the electrode surfaces between the spring contacts that in the free or unbiased state block such insertion. In relays made according to the present invention, however, the disc shaped PTC thermistor is angled into opening portion 422 and received under lip 440 which keeps the PTC thermistor in place while the second contact/terminal member 560 and cover 300 are assembled. Thus, it is unnecessary to employ any special tool, making it possible to reduce the cost involved by a reduction in the number of assembly steps.

In addition, the relay structure can be made thin as the PTC is horizontally arranged in the PTC case. The prior art relay has fulcrums at two locations and force application points at two locations. Whereas, the relay of the present invention has a fulcrum at one location and force application points at two locations, thereby realizing a failsafe mechanism by using a smaller number of contact points.

Further, separating the broken portions an extended distance utilizing the weight of thermistor portion PTC1 and by the force of the spring results in improved reliability of interrupting the current path.

Because the PCT is seated in the PTC case made of a heat-resistant resin and as the PTC thermistor does not touch the housing directly, there is a wider range of selection for the housing materials thereby making it possible to manufacture relays using cheaper materials, thus contributing to a reduction of the manufacturing cost.

As the first and second contact/terminal members 500 and 560 can be formed integrally with no welded parts, it becomes possible to reduce the manufacturing cost.

Since it is possible in this motor start relay to install the PTC thermistor on the terminal pins in a horizontal state, the thermistor receives heat more effectively from the electric compressor as compared with the PTC in the perpendicular position. Therefore, it becomes possible to reduce the electric power consumed by the PTC at the time of normal operation.

While a preferred embodiment of the invention has been disclosed in detail, it should be understood that various modifications may be adopted without departing form the spirit of the invention or scope of the appended claims. For example, it will be realized that the motor start relay made according to the invention can be provided without the overload protector mounted on the same housing so that it functions only to start the motor. Further, the motor start relay made according to this invention can be applied not only to the single-phase alternating current motor but also to various other motors.

What is claimed:

1. A motor start relay for use with a compressor with a motor contained herein comprising:

a housing formed of electrically insulative material having a bottom wall and sidewalls extending upwardly therefrom to define a chamber, a cover received on the sidewalls to close the chamber, a generally circular disc shaped positive temperature coefficient of resistivity (PTC) thermistor, the thermistor having opposite generally planar face surfaces, an electrode layer on each opposite face surface, a PTC case formed of heat resistant electrically insulative material received in the housing, the PTC case having a top surface and a bottom portion with a PTC thermistor receiving opening formed in the top surface configured to accommodate the PTC thermistor, the opening having first and second portions separated by a dividing member, the first portion of the opening aligned with the bottom portion of the PTC case and the second portion extending completely through the PTC case, the PTC thermistor received in the opening with the face surface of the PTC thermistor generally parallel to the top surface of the PTC case, a lip extending from the top surface into the first portion of the opening overlapping an outer peripheral portion of the disc shaped PTC thermistor, a first terminal/contact member mounted in the housing and having a first spring contact disposed below the PTC thermistor in engagement with one electrode layer and a second terminal/contact member mounted in the housing and having a second spring contact disposed above the PTC thermistor in engagement with the other electrode layer at an engagement location with the respective electrode layer which is offset from the engagement location of the first spring contact with the respective electrode layer, the second spring contact being disposed in the second portion of the opening whereby a broken portion of the PTC thermistor in the second portion of the opening will be ejected from the PTC case by means of the spring force of the second spring contact, said motor having a main and a start winding and said compressor having a compressor shell containing the motor, a plurality of terminal pins extending through the shell to provide an electrical interface with the motor, a terminal pin being held by the respective facing surfaces of each pair of legs of the spring attachment portions with the bottom wall of the housing and the electrode layers of the PTC thermistor approximately parallel with the shell at the location of the terminal pins.

2. A motor start relay according to claim 1 in which the terminal/contact members each have a generally U-shaped spring attachment portion formed of a pair of integrally connected legs, the bottom wall of the housing being formed with spring attachment recesses having spaced apart, facing walls and the spring attachment portions are received in a said respective spring attachment recess with the legs of each pair biased against the facing walls of the respective recess.

3. A motor start recess according to claim 2 in which a terminal pin receiving hole is formed in the bottom wall of the housing aligned with each spring attachment recess and aligned with the facing surfaces of each pair of legs so that pins inserted through the terminal pin receiving holes can be gripped by the pair of legs of the respective spring attachment portion.

4. A motor start relay according to claim 1 in which the first spring contact is received on a surface of the bottom portion of the PTC case and includes a portion biased against a generally centrally disposed location of the respective electrode layer.

5. A motor start relay according to claim 1 in which the second spring contact is biased against an outer peripheral portion of the respective electrode layer disposed diametrically opposite to that portion of the PTC thermistor overlapped by the lip.

6. A motor start relay according to claim 1 in which the bottom portion of the PTC case includes a surface portion disposed a selected distance below the top surface of the PTC case which limits the depth of insertion of the PTC thermistor in the opening.

7. A motor start relay according to claim 1 in which a sidewall of the housing is formed with an opening and the cover is formed with a window and further comprising a motor protector having a terminal pin receiving terminal located along a wall of the protector and blade terminals extending upwardly from the motor protector, the motor protector received on the sidewall of the housing with the terminal pin receiving terminal disposed in the opening in the sidewall and the cover being formed with a sidewall which is received over the motor protector with the blade terminals aligned with the window.

8. A motor start relay comprising:

a housing formed of electrically insulative material having a bottom wall and sidewalls extending upwardly therefrom to define a chamber, a cover received on the sidewalls to close the chamber, a sidewall of said sidewalls the housing being formed with an opening and the cover is formed with a window, a generally circular disc shaped positive temperature coefficient of resistivity (PTC) thermistor, the thermistor having opposite generally planar face surfaces, an electrode layer on each opposite face surface, a PTC case formed of heat resistant electrically insulative material received in the housing, the PTC case having a top surface and a bottom portion with a PTC thermistor receiving opening formed in the top surface configured to accommodate the PTC thermistor, the opening having first and second portions, the first portion of the opening aligned with the bottom portion of the PTC case and the second portion extending completely through the PTC case, the PTC thermistor received in the opening with the face surface of the PTC thermistor generally parallel to the top surface of the PTC case, a lip extending from the top surface into the first portion of the opening overlapping an outer peripheral portion of the disc shaped PTC thermistor, a first terminal/contact member mounted in the housing and having a first spring contact disposed below the PTC thermistor in engagement with one electrode layer and a second terminal/contact member mounted in the housing and having a second spring contact disposed above the PTC thermistor in engagement with the other electrode layer at an engagement location with the respective electrode layer which is offset from the engagement location of the first spring contact with the respective electrode layer, the second spring contact being disposed in the second portion of the opening whereby a broken portion of the PTC thermistor in the second portion of the opening will be ejected from the PTC case by means of the spring force of the second spring contact, and a motor protector having a terminal pin receiving terminal located along a wall of the protector and blade terminals extending upwardly from the motor protector, the motor protector received on the sidewall of the housing with the terminal pin receiving terminal disposed in the opening in the sidewall and the cover being formed with a sidewall which is received over the motor protector with the blade terminals aligned with the window.

* * * * *